US005218720A

United States Patent [19]

Tolton

[11] Patent Number: 5,218,720

[45] Date of Patent: Jun. 15, 1993

[54] INNER LINER FOR GARMENT SUITABLE FOR ATHLETIC ACTIVITIES

[76] Inventor: Gary A. Tolton, R.D. 6, Box 33125, Red Lion, Pa. 17356

[21] Appl. No.: 931,344

[22] Filed: Aug. 18, 1992

Related U.S. Application Data

[62] Division of Ser. No. 708,169, May 31, 1991, Pat. No. 5,138,717.

[51] Int. Cl.[5] ..... A41D 1/00

[52] U.S. Cl. ..... 2/97; 2/85; 2/93; 2/102; 2/108; 2/272; 2/DIG. 4

[58] Field of Search ..... 2/97, 85, 69, 102, 93, 2/94, 108, 272, DIG. 1, DIG. 4, 86, 87, 115

[56] References Cited

U.S. PATENT DOCUMENTS

| | | | |
|---|---|---|---|
| 1,721,074 | 7/1929 | Gross | 2/97 |
| 2,112,788 | 6/1937 | Rosenberg . | |
| 2,180,497 | 11/1939 | Barkin | 2/97 |
| 2,255,823 | 9/1941 | Silverstein | 2/97 |
| 2,292,348 | 8/1942 | Bailey | 2/97 |
| 2,322,451 | 5/1941 | Jones . | |
| 2,391,352 | 12/1945 | Schwartz | 2/97 |
| 2,398,258 | 1/1945 | Seegal . | |
| 2,415,996 | 2/1947 | Eilenberg | 2/97 |
| 2,443,447 | 6/1948 | Falcon | 2/94 |
| 2,603,789 | 7/1952 | Straus | 2/108 |
| 2,846,686 | 6/1955 | Tames . | |
| 4,543,670 | 10/1985 | Ehring . | |
| 4,631,753 | 12/1986 | Ehring . | |
| 4,896,379 | 1/1990 | Kape . | |
| 5,138,717 | 8/1992 | Tolton | 2/123 |

*Primary Examiner*—Clifford D. Crowder
*Assistant Examiner*—Gloria Hale
*Attorney, Agent, or Firm*—Hoffman, Wasson & Gitler

[57] ABSTRACT

An outer garment suitable for a variety of athletic endeavors is disclosed. The garment comprises an outer shell formed of a lightweight, waterproof material, and an inner liner of mesh-like material secured to the shell. The liner includes a back panel, and first and second front panels. A resilient insert, yieldable in all directions, is situated in the back panel to fit against the back of the wearer. Fasteners extend laterally about the liner, and manipulation of said fasteners draws the liner snugly about the torso of the wearer, without causing "bunching" of the jacket. "Bunching" is unsightly, and also interferes with the athletic activities envisioned by the wearer.

7 Claims, 2 Drawing Sheets

INNER LINER FOR GARMENT SUITABLE FOR ATHLETIC ACTIVITIES

This is a divisional of copending application Ser. No. 07/708,169 filed on May 31, 1991, now U.S. Pat. No. 5,138,717.

BACKGROUND OF THE INVENTION (1) Field of the Invention:

This invention relates broadly to an outer garment, such as a jacket, suitable for golfers, runners,, hunters, etc. More particularly, this invention relates to an adjustable inner liner that is joined to the exterior shell of such garment.

(2) Prior Art:

There has been a long standing need for an outer garment, such as a jacket, that could be worn under different climatic conditions for diverse athletic activities. Such garment would enable the wearer to perform strenuous exercises, without having the sleeves of the jacket "ride-up" along the arms of the wearer, or the body of the jacket "gather-up" or "bunch-up", in unsightly, bulky, restricting, gatherings of excess material. While neither the sleeve movement nor the gathering of excess material is a significant problem to the average person, under normal conditions, such distractions are magnified in significance when the wearer is engaged in an event requiring skill and concentration. Thus, the slightest shifting of the sleeves of the garment may distract the golfer from successfully addressing a golf ball, or a hunter from shooting his prey, or a skier from executing a turn, or a tennis player from returning a hard hit ball, etc.

Additionally, the outer garment must be capable of being worn under diverse climatic conditions, so that the owner of such garment can wear same for several months of the year, in mild weather and in seasonably cold weather, with equal comfort. The outer garment must achieve its suitability for diverse athletic activities without sacrificing its attractiveness for casual wear, thus appealing to a wide segment of the purchasing public.

Manifestly, the objectives stated above have been addressed by numerous clothing designers over the years, and with varying degrees of success. In order to obtain adequate warmth for outdoor wear, one has had to accept bulky fabrics, which interfered with athletic activities, at least in some instances. In other approaches, exotic light-weight materials have been utilized that have priced the resulting outer garment at such a level that only the very well-to-do can afford to purchase same.

One attempt to address the conflicting demands placed upon the designer and/or manufacturer of outer garments for athletic purposes is shown in U.S. Pat. No. 2,112,788, granted Mar. 29, 1938, to Gordon W. Rosenberg. Such patent discloses an outer garment, such as a golfing jacket, that provides a maximum degree of freedom for the upper part of the wearer's body, while still maintaining a neat appearance. Rosenberg relies upon an elastic lining 7, 8 within the garment. The elastic lining, as noted in column 1, lines 19–33 of Rosenberg, urges the sleeves to a normal position relative to body 1 of the garment, and maintains the sleeves in such position until the wearer's arms or shoulders are moved. Cross-stitched connections 9 between sleeves 2 and extensions 5, and pleats 15 defined between the rear panel 8 of lining 7 and back section 1 of the garment, further enhance the ability of the wearer to move his arms and shoulders relatively freely.

The outer garment disclosed by Rosenberg, and by numerous others, appreciated that the outer garment might well be made in two major components, namely, an outer shell comprising the body with the sleeves secured thereto, and a resilient, light-weight liner. The outer shell could be formed of a material, such as leather or cloth, that would resist the cold weather, while the liner would fit about the body of the wearer. The liner could be made of a porous mesh material for comfort.

Although the elastic liner 7, 8 used in the garment disclosed in Rosenberg permitted the shoulder and back to expand, the sleeves, which lacked cuffs, would tend to shift on the arms of the wearer; such shifting would be accentuated whenever the wearer moved his arms in a swinging manner. Also, the liner 7, 8 was not adjustable, and would not always fit snugly about the body of the wearer.

Thus, it should be noted that no known outer garment has been able to satisfactorily address the oft-times conflicting demands of suitability for wear under different climatic conditions, diverse athletic endeavors requiring different movements of the arms, individualized fit, and reasonable cost. To the extent that such demands may be met by a single outer garment, and not by a collection of outer garments designed solely for one activity, such as golfing, or tennis, etc., the present invention represents a novel clothing design neither disclosed, nor suggested, by the prior art designers and/or manufacturers.

Such design places particular emphasis upon a unique inner liner that employs a resilient, yieldable insert in an unyielding, mesh-like back panel, and manually operable fasteners for adjusting the liner about the chest and stomach of the wearer. The liner thus serves to customize the jacket for each wearing, and the snugness of the fit pulls the outer shell into conformance with the body of the wearer. The garment thus does not "bunch up" or "gather-up" in the vicinity of the wearer's stomach and chest. The resultant garment follows the silhouette of the front side of the wearer, and allows the wearer greater freedom of movement during all endeavors.

SUMMARY OF THE INVENTION

Thus, with the deficiencies of known outer wear garments clearly in mind, the present invention contemplates an outer garment that is suitable for wear by athletes participating in all kinds of strenuous activities, and under widely varying climatic conditions. The present invention relies upon an outer shell that is light-weight and waterproof, and has a porosity that allows perspiration vapor to escape, and a mesh-like inner liner, with a yieldable insert, and manually operable adjustable fasteners that can be adjusted to facilitate tailoring of the front side of the jacket to fit snugly in the stomach and chest area of the wearer.

In addition to the novel "piston and cylinder" cuff arrangement disclosed, and claimed in parent application Ser. No. 07/708,169, the present invention further relies upon a unique liner that comprises a back panel situated between a pair of front panels; a resilient insert, that is yieldable in all directions, is sewn into, or otherwise secured to, the back panel. In contrast to the insert, the front panels and the remainder of the back panel of the liner, are unyielding.

The relationship of the back panel to the front panels may be altered by adjustable fasteners. The liner may thus be adjusted circumferentially, to closely approximate the contour of the wearer, thereby drawing the front panels of the outer shell into contact with the wearer, since the liner is sewn into the shell. In essence, the fasteners allow the wearer of the jacket to "customize" the jacket to his body, enhancing its wearing comfort and preventing bunching of the jacket, at the front thereof.

The several fasteners used to conform the liner to the torso of the wearer may be a series of laterally extending snap fasteners, Velcro fasteners, or the like. The fasteners may be opened, or released, as the wearer gains, or loses weight, so that the same jacket always fits comfortably. A resilient band at the lower edge of the back of the outer garment anchors the outer garment on the body of the wearer when the closures, such as buttons or zippers, on the front of the garment are operated.

Vertically extending vanishing pleats are defined in the back of the outer shell of the garment. Such pleats expand to allow free movement of the shoulders and sleeves of the garment relative to the body of the jacket. A vanishing pleat is a pleat so configured that it opens widest at its upper end and tapers, or disappears, at its lower end into the body of the garment. The vanishing pleats thus offer maximum mobility at the shoulder of the wearer, prevent water from accumulating in the lower end thereof, and are cosmetically appealing.

The "piston and cylinder" cuff arrangement, the snug fitting liner, and the pleats in the outer shell, function in harmony to provide the wearer of the garment an excellent, customized fit and unimpeded movement of his arms, even when undertaking vigorous exercise requiring extensive arm movement. The snug fitting liner serves as an anchor to position, and retain, the garment in a fixed position on the body of the wearer. The elimination of "bunching", or gathering, of excess material, in the region of the chest or stomach of the wearer, insures that the jacket assumes a sleek silhouette on the body of the wearer. Obviating the bunching, or gathering, of material enables the wearer to wear the jacket while hunting, golfing, playing tennis, and numerous other activities wherein the interference from the accumulated material may adversely affect such activity.

DETAILED DESCRIPTION OF THE INVENTION

Figure 1:
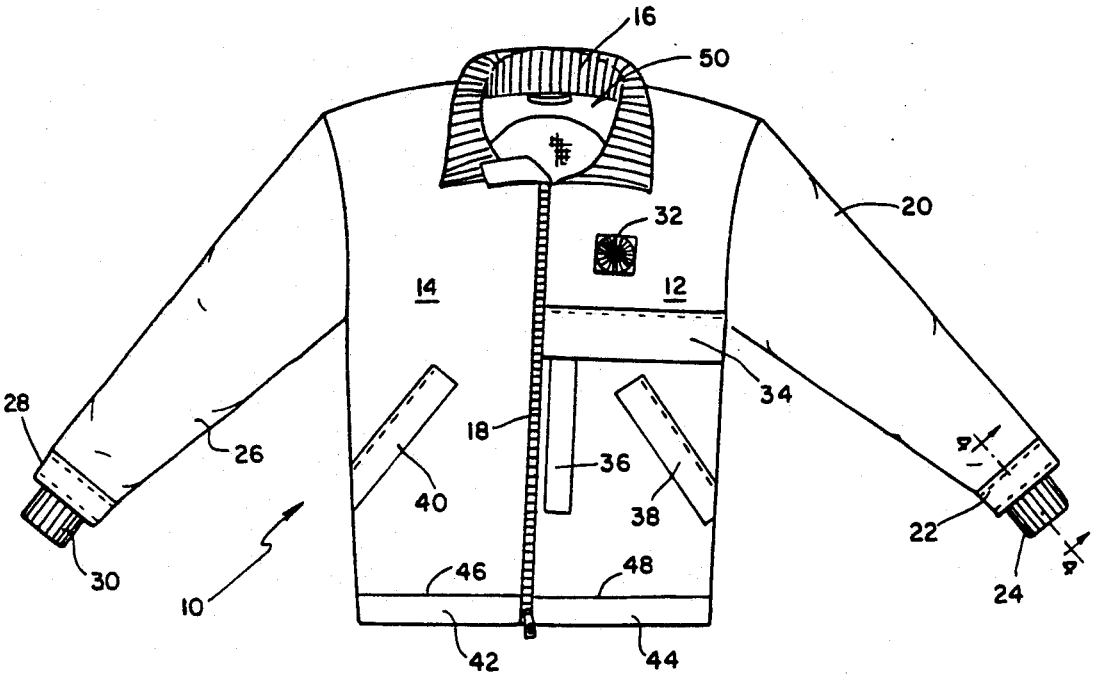
FIG. 1 is a front elevational view of an active-wear garment constructed in accordance with the principles of the present invention, such garment being shown in its closed position.

Referring now to the drawings, FIG. 1 shows an activewear jacket 10 constructed in accordance with the principles of the invention. Jacket 10 comprises an outer shell that is lightweight, waterproof, and has sufficient porosity to allow perspiration vapor to escape; one commercially available material that fits these criteria is a texturized polyester two-layer film, manufactured by G. L. Gore and Associates, Inc., of Elkton, Md. 21921-0729 under the mark GORE-TEX. Jacket 10 includes a first front panel 12, a second front panel 14, and a collar 16 that extends about the neck of the wearer. A zipper 18, when operated, secures the panels 12, 14 together. A first sleeve 20 is secured to the body of the jacket in the area of intersection with panel 12; a cuff 22 is defined at the free end of first sleeve 20, and a wristlet 24 extends beyond the cuff 22. A second sleeve 26 is secured to the body of the jacket in the area of intersection with panel 14; a cuff 28 is defined at the free end of sleeve 26, and a wristlet 30 extends beyond the cuff 28.

A decorative logo 32 is emblazoned on panel 12, and a flap 34 extends horizontally across the panel. A vertically oriented flap 36 protects the entrance into a deep pocket defined between the panel 12 and the inner liner of the jacket, while a diagonally extending flap 38 protects the entrance into another pocket.

Another diagonal flap 40, on panel 14, protects the entrance into yet another pocket. The lower end of panel 14 terminates in a bottom section 42 of folded-over fabric, while the lower end of panel 12 terminates, similarly, in a bottom section 44 of folded-over fabric. The upper limit 46 of section 42 is indicated by a line of stitches, and the upper limit 48 of section 44 is indicated by a line of stitches. A segment of the inner liner of the jacket is visible in the vicinity of collar 16 in FIG. 1; the inner liner is indicated generally by reference numeral 50.

Figure 2:
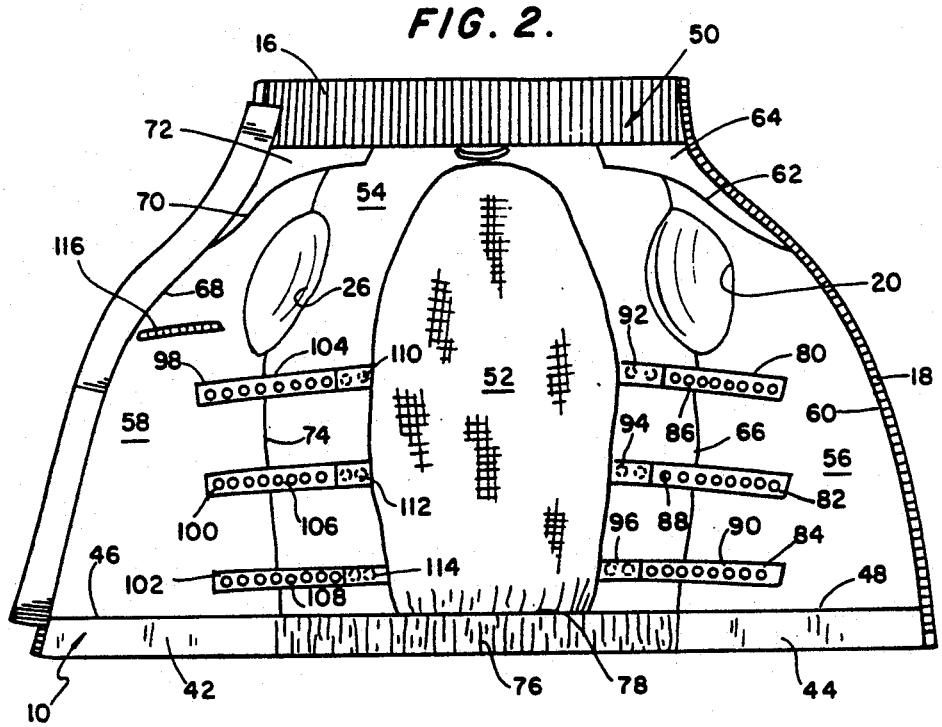
FIG. 2 is a front elevational view of the garment of FIG. 1, such garment being shown in its opened condition to reveal the unique liner secured to the outer shell of the garment.

FIG. 2 depicts jacket 10, in its opened condition, wherein zipper 18 has been unzipped, and panels 12, 14 have been folded back to reveal the details of inner liner 50. Liner 50 comprises a central, resilient, insert 52 that yields readily in all directions, a back panel 54, a first front panel 56, and a second front panel 58. Panels 54, 56 and 58 are all formed of a porous, mesh-like material. However, while insert 52 is fashioned from a readily yieldable material, panels 54, 56, and 58, are fashioned from a different, durable, but unyielding material. Consequently, insert 52 can be deformed relative to the supporting panels to which it is secured. Insert 52, which resembles an inverted U-shaped area, is sewn, or otherwise set, into the back panel 54 of the inner liner 50 of jacket 10. Insert 52 contacts the back of the wearer of the jacket. A suitable insert has proven to be a 100% Dacron material.

One edge of first front panel 56 of the inner liner is sewn into engagement with the inner surface of panel 12 of the shell along stitch line 60; line 60 is located inwardly of zipper 18 and indicates the joinder of the zipper to the body of the jacket and side panel 56 of the liner. Front panel 56 is also secured to front panel 12 of the shell along line 48. Thus, the outer shell, and the inner liner, of the jacket move in concert.

Front panel 56 is also sewn along diagonal line 62 to interior tab 64 in the vicinity of the collar; the interior tab is made from the same material as the outer shell of the jacket. Front panel 56 and rear panel 54 of the liner are joined together by sewing along vertical line 66, which intersects the opening into sleeve 20.

One edge of second front panel 58 is sewn into engagement with the inner surface of panel 14 of the outer shell along stitch line 68. Line 68 is located inwardly of the zipper and indicates the joinder of the zipper to the body of the jacket and front panel 58 of the liner. Front panel 58 is also secured to front panel 14 along line 46. Since front panel 58 of the liner is secured to the front panel of the jacket, and vice versa, the shell and the inner liner of the jacket move in concert.

Front panel 58 is also sewn along diagonal line 70 to interior flap 72 in the vicinity of the collar; the interior tab is made from the same material as the outer shell of the jacket. Front panel 58 and rear panel 54 of the liner are joined together, by sewing along vertical line 74, which intersects the opening into sleeve 26.

An elastic section 76 is situated at the lower end of the back of the jacket, and such section fits between bottom sections 42 and 44. Section 76 is secured to the lower edges of the insert 52 and rear panel 54 of the inner liner.

Three, parallel, cloth straps 80, 82 and 84 extend horizontally across front panel 56 and rear panel 54 of the inner liner. Several receptacles 86 extend across the width of strap 80, several receptacles 88 extend across the width of strap 82, and several receptacles 90 extend across the width of strap 90. Snap buttons 92 are located on the end of strap 80 closest to insert 52, snap buttons 94 are located on the end of strap 82 closest to insert 52, and snap buttons 96 are located on the end of strap 84 closest to insert 52. Each strap is individually adjustable, by the simple expedient of pressing the snap fastener into the selected ones of the receptacles on the same strap.

In a similar fashion, three parallel cloth straps 98, 100 and 102 extend horizontally across front panel 58 and rear panel 54 of the inner liner. Several receptacles 104 extend across the width of strap 98, several receptacles 106 extend across the width of strap 100, and several receptacles 108 extend across the width of strap 102. Snap buttons 110 are located on the end of the strap 98 closest to insert 52, snap buttons 112 are located on the end of strap 100 closest to insert 52, and snap buttons 114 are located on the end of strap 102 closest to insert 52. Each strap is individually adjustable. An inner pocket 116 is formed in the inner liner, between the liner and the shell of the jacket.

Figure 3:
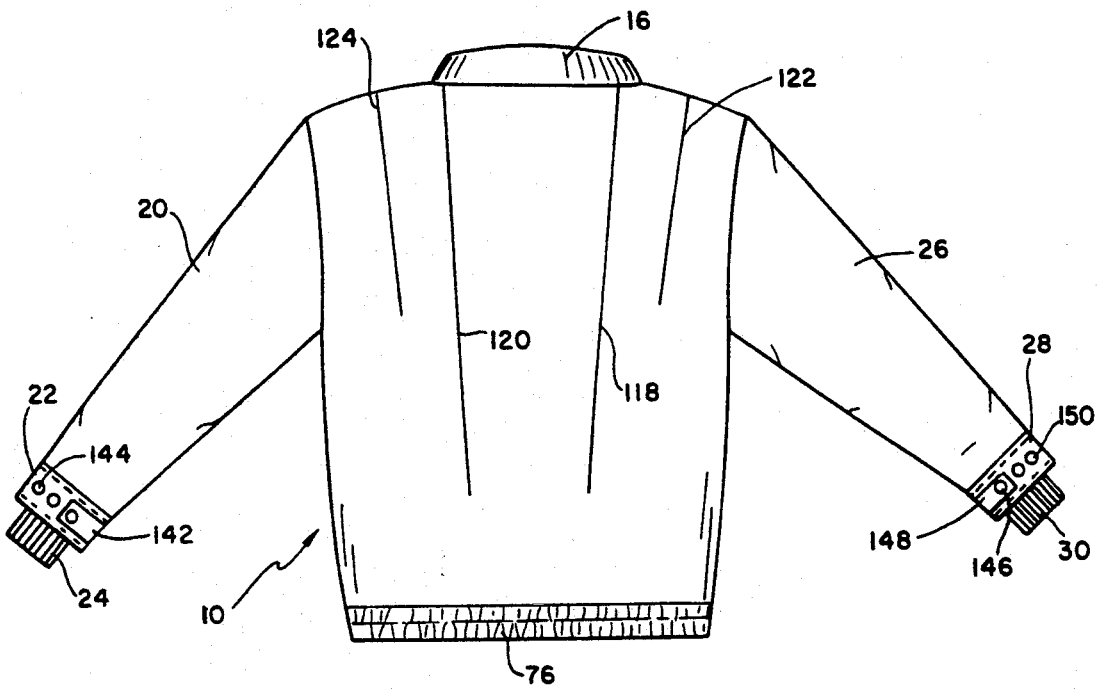
FIG. 3 is a rear elevational view of the garment of FIG. 1, such garment being shown in its closed condition.

FIG. 3 illustrates the back of the jacket 10. Elongated central vanishing pleats 118, 120 are formed on opposite sides of the back of the jacket, and shorter vanishing pleats 122, 124 are formed in the vicinity of the shoulders of the jacket. The pleats expand to allow freer movement of the shoulders and sleeves of the jacket relative to the body of the jacket.

Figure 4:
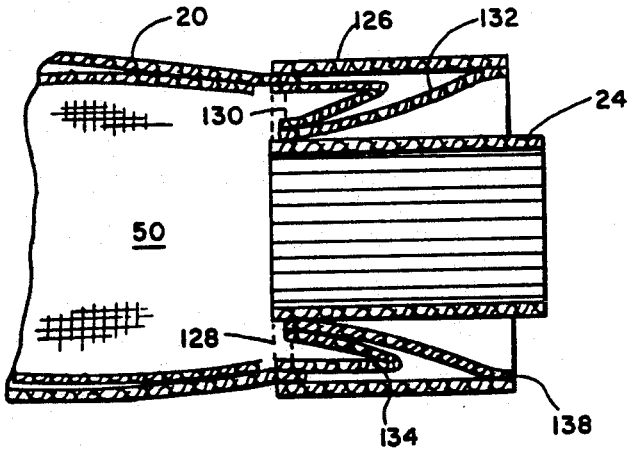
FIG. 4 shows, on an enlarged scale, the "false" cuff construction employed at the free end of each sleeve of the active wear garment; such view is taken along line 4—4 in FIG. 1 and in the direction indicated.

FIG. 4 is a cross-sectional view taken through a fragment of one of the sleeves of the jacket, near the free end thereof. Although the cross-sectional view is taken through sleeve 20 along line 4—4 in FIG. 1, and in the direction indicated, it is noted that sleeve 26 is configured in an identical fashion. The cross-sectional view is taken on a farlarger scale than the views of FIGS. 1–3.

A cuff 22 is formed at the free end of sleeve 20, and a wristlet 24 projects beyond the cuff. Wristlet 24 is formed of a ribbed fabric tubing that engages the wrist of the wearer of the jacket. The inherent resiliency of the fabric tubing causes the wristlet to snugly engage the wrist of the wearer, and the length of the wristlet is chosen to insure that the cuff does not ride over the wrist of the wearer.

Cuff 22, upon further inspection, might be considered to be a "false" cuff, for the cuff, although made of the same material as the shell of the jacket, is not formed, in the conventional manner, by folding over the free end of the sleeve. In fact, cuff 22 is a cylinder 126 of the same porous, waterproof material as the shell, and is sewn onto the free end of the sleeve 20 of the shell, along annular stitch lines 128 and 130. Cylinder 126 is usually two and a half inches in length.

Sleeves 20, 26 are lined for maximum comfort by extending liner 50 for the length of each sleeve. The liner reaches to the free end of each sleeve, stopping short of the "false" cuff, and is joined to the outer shell of the jacket, as shown in FIG. 4. A gusset 132, formed of the same porous, waterproof material as the shell of the jacket, extends between the free end of cylinder 126 and the inner end of the wristlet 24. One end of gusset 132 is sewn, or otherwise secured, to cylinder 126, while the other end of gusset 132 is sewn, or otherwise secured, to wristlet 24. Gusset 132 permanently attaches the wristlet 24 to cylinder 126.

A resilient band 134 is sewn between the cylinder 126 and wristlet 24. The resilient band may be formed of the same yieldable, mesh-like resilient material as the insert 52 for the inner liner 50. The flexible band may elongate between two and a half and three inches in axial length, when needed. Also, as shown in FIG. 4, the resilient band may have a loop formed therein, such loop allowing unimpeded movement of the wristlet before the loop unfurls and the band exerts a resistive force upon the wristlet. Additionally, the gussets 132, 134 conceal the resilient bands from view, further enhancing the visual appeal of the outer garment. The gussets are fabricated from the same material as the outer shell, and isolate the interior of the jacket from the external climatic conditions.

SUMMARY OF OPERATION

The manner of utilizing the jacket 10, shown in detail in the preferred embodiment of FIGS. 1–4, may be summarized in the following manner. Starting with FIG. 1, the wearer, or user, opens, or unzips, zipper 18 so that the interior of the jacket is visible. As shown in FIG. 2, liner 50 is adjustable so that it may fit snugly about the body of the wearer, particularly in the area of the sides, stomach and back. The liner is adjusted, as needed, by pressing the snap buttons 92, 94, and 96 into the selected receptacles 86, 88, 90 secured to straps 80, 82, and 84. The same procedure is followed by pressing buttons 110, 112, 115 into receptacles 104, 106, 108 on straps 98, 100, 102. By virtue of such adjustment, resilient insert 52 bears against the back of the wearer. The jacket is then zipped closed by drawing zipper 18 upwardly. Elastic section 76, shown in FIGS. 2 and 3, is drawn against the back of the wearer.

As shown in FIG. 3, the pleats 118, 120, 122, 124 provide additional clearance for the shoulders of the wearer, and allow unimpaired movement of the shoulders. After the liner 50 has been adjusted, and the jacket has been closed, the wearer then adjusts, or tightens, the cuffs 22, 28 about his wrists. Cuff 22 may be tightened by shifting the snap fasteners 140 on flap 142 toward snap receptacles 144 to reduce the diameter of the cuff; cuff 28 may be tightened by shifting the snap fastener 146 on flap 148 toward snap receptacles 150 to reduce the diameter of the cuff. By tightening the cuffs 22 and 28, properly adjusting the wristlets 24, 30, and adjusting the elastic section 76, the wearer has anchored the jacket 10, in a comfortable fashion, about his body and upon his arms. The wearer may then engage in any vigorous and/or strenuous activity that he wishes, and the jacket will remain fixed in place, and will not interfere with, or impede, such activity.

FIG. 2 shows the manner in which the movement of the body of the wearer is absorbed by the resilient, yieldable insert, and is not transmitted by the resilient, yieldable insert 52 to the side panels of the jacket. When the stress forces are terminated, insert 52 returns to its normal, unstressed position. Consequently, the jacket does not "bunch-up", or gather, particularly in the area of the stomach, and chest of the user, but remains flat and in contact with the body of the wearer.

FIG. 4 stresses that the cuffs 22, 28, which are actually "false" cuffs, are isolated from the forces acting upon inner liner 50 for the jacket. The cuffs 22, 28 are indirectly joined to the free ends of sleeves 20, 26 by gussets, such as gusset 132. A resilient band, such as band 134, is sewn between the interior of the cuff and the gusset.

While the preferred embodiment of the active wear garment has been shown in FIGS. 1–4, other refinements, revisions, and/or modifications, may occur to the skilled artisan. Consequently, the appended claims should be broadly construed, in a manner consistent with the significant advance in the useful arts and sciences, set forth by this invention and should not be limited to their literal terms.

I claim:

1. An outer garment suitable for wear during athletic activities, said garment comprising:

a) an outer shell formed of a material having sufficient porosity to allow perspiration vapor from the body of the wearer to escape therethrough;

b) said shell comprising a first front panel, a second front panel, a back panel secured to said first and second front panels and extending therebetween, and a pair of sleeves;

c) fastener means for joining said first and second front panels together about the chest and stomach of the wearer;

d) an inner liner formed of a porous, meshlike material;

e) said inner liner comprising a back panel, and first and second front panels;

f) said first and second front of said panels inner line being secured to the corresponding front panels of said outer shell for movement therewith;

g) a resilient, yieldable insert secured within the back panel of said liner to fit against the back of the wearer;

h) manually operable means situated between said back panel and said first and second front panels of said liner for pulling selected areas of said liner away from said shell;

i) said manually operable means being manipulated by the wearer of the garment to draw said front panels of said liner closely about the sides and stomach of the wearer while retaining said insert in contact with the back of the wearer; and j) said insert being yieldable in all directions in response to movement of the wearer, without interfering with such movement.

2. An outer garment as defined in claim 1 wherein an opening is formed in the rear panel of said liner, and said insert is sewn into said opening.

3. An outer garment as defined in claim 1 wherein said insert covers a large area of the back of the wearer.

4. An outer garment as defined in claim 1 wherein several vanishing pleats are formed in the panel of the shell back of said garment, said vanishing pleats being expandable at the top to allow free movement of the shoulders of the wearer and vanish, at the lower end thereof, into the body of the back panel of the shell of the garment.

5. An outer garment as defined in claim 1 wherein said manually operable means comprise parallel straps with two ends attaching horizontally about said rear panel and said front panels of said liner and secured thereto, snap fasteners secured to one end of said straps, and receptacles secured to the other end of said straps.

6. An outer garment as defined in claim 5 wherein a first plurality of straps are secured to said rear panel of said liner and said first front panel of said liner, and a second plurality of straps are secured between said rear panel of said liner and said second front panel of said liner, said first and second plurality of straps being aligned with each other.

7. An outer garment as defined in claim 1 wherein said first front panel of said garment includes a top and a lower end and terminates, at its lower end, in a bottom section of folded-over material, said second front panel of said garment includes a top and a lower end and terminates, at its lower end, in a bottom section of folded over material, and a band of resilient material extends between said first and second front panels across the lower end of the back panel of said shell to draw the garment against the body of the wearer in the vicinity of the waist.

* * * * *